US006851239B1

(12) United States Patent
Hohmann et al.

(10) Patent No.: US 6,851,239 B1
(45) Date of Patent: Feb. 8, 2005

(54) TRUE-JOINT ANCHORING SYSTEMS FOR CAVITY WALLS

(75) Inventors: Ronald P. Hohmann, Hauppauge, NY (US); Ronald P Hohmann, Jr., Hauppauge, NY (US)

(73) Assignee: Hohmann & Barnard, Inc., Hauppauge, NY (US)

( * ) Notice: Subject to any disclaimer, the term of this patent is extended or adjusted under 35 U.S.C. 154(b) by 93 days.

(21) Appl. No.: 10/300,519

(22) Filed: Nov. 20, 2002

(51) Int. Cl.[7] ..... E04B 1/38

(52) U.S. Cl. ..... 52/513; 52/565; 52/713; 52/379

(58) Field of Search ..... 52/513, 565, 713, 52/379

(56) References Cited

U.S. PATENT DOCUMENTS

| | | | | |
|---|---|---|---|---|
| 3,377,764 A | | 4/1968 | Storch | 52/426 |
| 4,021,990 A | | 5/1977 | Schwalberg | 52/714 |
| 4,373,314 A | | 2/1983 | Allan | 52/434 |
| 4,473,984 A | | 10/1984 | Lopez | 52/410 |
| 4,869,038 A | | 9/1989 | Catani | 52/712 |
| 4,875,319 A | | 10/1989 | Hohmann | 52/383 |
| 5,392,581 A | | 2/1995 | Hatzinikolas et al. | 52/712 |
| 5,408,798 A | | 4/1995 | Hohmann | 52/562 |
| 5,454,200 A | | 10/1995 | Hohmann | 52/513 |
| 5,456,052 A | | 10/1995 | Anderson et al. | 52/379 |
| 5,634,310 A | * | 6/1997 | Hohmann | 52/513 |
| 5,816,008 A | | 10/1998 | Hohmann | 52/565 |
| 6,209,281 B1 | | 4/2001 | Rice | 52/379 |
| 6,279,283 B1 | | 8/2001 | Hohmann et al. | 52/379 |

OTHER PUBLICATIONS

Cantini, Mario J.; Heavy Duty Joint Reinforcement, *Masonry*, Apr. 1995.

Lochonic, K. et al; Wall Reinforcing Design, *The Story Pole*, Aug. 2001.

Dur–O–Wal, Inc., Product Catalog (Aurora, II; 2000).

Wire Bond Corp.; Product Catalog (Charlotte, NC; 2002/2003).

Hohmann & Barnard, Inc.; Product Catalog (Hauppauge, NY; 2002).

ASTM Standard Specification for Masonry Joint Reinforcement; Designationn A 951–00 (Approved Sep. 10, 2000; Published Oct., 2000).

DURO–WAL Tech Paper 93–1 (undated).

* cited by examiner

*Primary Examiner*—Milton Nelson, Jr.
(74) *Attorney, Agent, or Firm*—Siegmar Silber, Esq.

(57) ABSTRACT

A high-span anchoring system is described for a cavity wall incorporating a wall reinforcement combined with a wall tie which together serve a wall construct having a larger-than-normal cavity. Further the various embodiments combine wire formatives which are compressively reduced in height by the cold-working thereof. Among the embodiments is a veneer anchoring system with a low-profile wall tie for use in a heavily insulated wall. The compressively reduced in height wall anchors protrude into the cavity through the seams, between insulation strips, which seams seal thereabout and maintain the integrity of the insulation by minimizing air leakage. Further, the eye wires extend across the insulation into the cavity between the wythes, and each accommodates the threading thereinto of a wire facing anchor or wall tie with either a pintle inserted through the eye or the open end of the veneer tie. The veneer tie is then positioned so that the insertion end is embedded in the facing wall. The close control of overall heights permits the mortar of the bed joints to flow over and about the wall reinforcement and wall tie combination inserted in the inner wythe and insertion end of the wall in the outer wythe. Because the wire formatives hereof employ extra strong material and benefit from the cold-working of the metal alloys, the high-span anchoring system meets the unusual requirements demanded thereof.

15 Claims, 7 Drawing Sheets

TRUE-JOINT ANCHORING SYSTEMS FOR CAVITY WALLS

BACKGROUND OF THE INVENTION

1. Field of the Invention

This invention relates to an improved reinforcement structure for cavity walls, and, more particularly, to combined wall anchors and reinforcement trusses or ladders that utilize true-joints to fuse together the components under high heat and high pressure. The resultant anchoring systems meet high flatness requirements facilitating the formation of uniform mortar bed joints. This avoids stackup tolerances and reduces the cutting of blocks to fit within the height requirements. The flatness of the combined wall reinforcement and wall anchor enables the mason to more easily maintain the verticality of the wall.

2. Description of the Prior Art

Recently, special attention has been drawn to products that not only improve a mason's productivity, but also aid in straighter joint lines and ultimately better looking buildings. Among these products are cavity wall anchoring systems that tie together backup walls and facing veneers. While the backup walls or inner wythes may be masonry blocks, dry wall construction or poured concrete, this invention provides several examples of true jointed wall reinforcements and wall anchors for use with masonry black backup walls.

To date, numerous anchoring devices for insertion in bed joints of the backup walls have been marketed. In the main, each of these devices have a portion thereof or a separate interengaging component that is inserted in a corresponding bed joint of the facing veneer. Backup walls of masonry blocks also have a requirement that joint reinforcement be used. Standards in the construction industry have evolved to include a masonry joint reinforcement standard, namely, ASTM Standard Specification A951-00 which describes joint reinforcement fabricated from cold drawn steel wire. As the production of better looking buildings requires uniformity in laying up the inner and the outer wythe, the competition for bed joint space between reinforcement materials and anchoring devices needs to be resolved in a manner satisfactory to the mason.

Over the past forty years there has been growing acceptance of wire formatives not only for wall reinforcements, but also for wall anchors and veneer anchors. It has become increasingly common to look toward a 0.375-inch high bed joint in both the inner wythe and the outer wythe. To maintain uniform joints, masons look toward mortar coverage above the reinforcement and wall anchor combination so that successive blocks are supported by the mortar layer and not by the wire formative. This enables the mason to adjust the placement of the block to maintain uniformity.

In the past, the use of wire formatives have been limited by the mortar layer thicknesses which, in turn are dictated either by the new building specifications or by pre-existing conditions, e.g. matching during renovations or additions the existing mortar layer thickness. While arguments have been made for increasing the number of the fine-wire anchors per unit area of the facing layer, architects and architectural engineers have favored wire formative anchors of sturdier wire. On the other hand, contractors find that heavy wire anchors, with diameters approaching the mortar layer height specification, frequently result in misalignment. Thus, these contractors look towards substituting thinner gage wire formatives which result in easier alignment of courses of block.

In the past, there have been investigations relating to the effects of various forces, particularly lateral forces, upon brick veneer construction having wire formative anchors embedded in the mortar joint of anchored veneer walls. The seismic aspect of these investigations were referenced in the first-named inventor's prior patents, namely, U.S. Pat. Nos. 4,875,319 and 5,408,798. Besides earthquake protection, the failure of several high-rise buildings to withstand wind and other lateral forces has resulted in the incorporation of a requirement for continuous wire reinforcement in the Uniform Building Code provisions. The first-named inventor's related Seismiclip$^R$ and DW-10-X$^R$ products (manufactured by Hohmann & Barnard, Inc., Hauppauge, N.Y. 11788) have become widely accepted in the industry. The use of a wire formative anchors in masonry veneer walls has also demonstrated protectiveness against problems arising from thermal expansion and contraction and has improved the uniformity of the distribution of lateral forces in a structure. However, these investigations do not address the mortar layer thickness vs. the wire diameter of the wire formative or technical problems arising therefrom.

In the course of preparing this disclosure several patents became known to the inventors hereof. The following patents are believed to be relevant and are discussed further as to the significance thereof:

| Patent | Inventor | Issue Date |
|---|---|---|
| 3,377,764 | Storch | Apr. 16, 1968 |
| 4,021,990 | Schwalberg | May 10, 1977 |
| 4,373,314 | Allan | Feb. 15, 1983 |
| 4,473,984 | Lopez | Oct. 02, 1984 |
| 4,869,038 | Catani | Sep. 26, 1989 |
| 4,875,319 | Hohmann | Oct. 24, 1989 |
| 5,392,581 | Hatzinikolas et al. | Feb. 28, 1995 |
| 5,408,798 | Hohmann | Apr. 25, 1995 |
| 5,454,200 | Hohmann | Oct. 03, 1995 |
| 5,456,052 | Anderson et al. | Oct. 10, 1995 |
| 5,816,008 | Hohmann | Oct. 15, 1998 |
| 6,209,281 | Rice | Apr. 03, 2001 |
| 6,279,283 | Hohmann et al. | Aug. 28, 2001 |

It is noted that with some exceptions these devices are generally descriptive of wire-to-wire anchors and wall ties and have various cooperative functional relationships with straight wire runs embedded in the interior and/or exterior wythe. Several of the prior art items are of the pintle and eyelet/loop variety.

U.S. Pat. No. 3,377,764—D. Storch—Issued Apr. 16, 1968

Discloses a bent wire, tie-type anchor for embedment in a facing exterior wythe engaging with a loop attached to a straight wire run in a backup interior wythe.

U.S. Pat. No. 4,021,990—B. J. Schwalberg—Issued May 10, 1977

Discloses a dry wall construction system for anchoring a facing veneer to wallboard/metal stud construction with a pronged sheet-metal anchor. Like Storch '764, the wall tie is embedded in the exterior wythe and is not attached to a straight wire run.

U.S. Pat. No. 4,373,314—J. A. Allan—Issued Feb. 15, 1983

Discloses a vertical angle iron with one leg adapted for attachment to a stud; and the other having elongated slots to accommodate wall ties. Insulation is applied between projecting vertical legs of adjacent angle irons with slots being spaced away from the stud to, avoid the insulation.

U.S. Pat. No. 4.473,984—Lopez—Issued Oct. 2, 1984
Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,869,038—M. J. Catani—Issued 091/26/89
Discloses a veneer wall anchor system having in the interior wythe a truss-type anchor, similar to Hala et al. '226, supra, but with horizontal sheetmetal extensions. The extensions are interlocked with bent wire pintle-type wall ties that are embedded within the exterior wythe.

U.S. Pat. No. 4,879,319—R. Hohmann—Issued Oct. 24, 1989
Discloses a seismic construction system for anchoring a facing veneer to wallboard/metal stud construction with a pronged sheet-metal anchor. Wall tie is distinguished over that of Schwalberg '990 and is clipped onto a straight wire run.

U.S. Pat. No. 5,392,581—Hatzinikolas et al.—Issued Feb. 28, 1995
Discloses a cavity-wall anchor having a conventional tie wire for mounting in the brick veneer and an L-shaped sheetmetal bracket for mounting vertically between side-by-side blocks and horizontally on atop a course of blocks. The bracket has a slit which is vertically disposed and protrudes into the cavity. The slit provides for a vertically adjustable anchor.

U.S. Pat. No. 5,408,798—Hohmann—Issued Apr. 25, 1995 and U.S. Pat. No. 5,454,200—Issued Oct. 3, 1995
Discloses a seismic construction system for a cavity wall having a masonry anchor, a wall tie, and a facing anchor. Sealed eye wires extend into the cavity and wire wall ties are threaded therethrough with the open ends thereof embedded with a Hohmann '319 (see supra) clip in the mortar layer of the brick veneer. The Hohmann '200 patent is noted for the positive interengagement of the veneer anchor with the insertion end thereof sealed in the bed joint of the outer wythe.

U.S. Pat. No. 5,456,052—Anderson et al.—Issued Oct. 10, 1995
Discloses a two-part masonry brick tie, the first part being designed to be installed in the inner wythe and then, later when the brick veneer is erected to be interconnected by the second part. Both parts are constructed from sheetmetal and are arranged on substantially the same horizontal plane.

U.S. Pat. No. 5,816,008—Hohmann—Issued Oct. 15, 1998
Discloses a brick veneer anchor primarily for use with a cavity wall with a drywall inner wythe. The device combines an L-shaped plate for mounting on the metal stud of the drywall and extending into the cavity with a T-head bent stay. After interengagement with the L-shaped plate the free end of the bent stay is embedded in the corresponding bed joint of the veneer.

U.S. Pat. No. 6,209,281—Rice—Issued Apr. 3, 2001
Discloses a masonry anchor having a conventional tie wire for mounting in the brick veneer and sheetmetal bracket for mounting on the metal-stud-supported drywall. The bracket has a slit which is vertically disposed when the bracket is mounted on the metal stud and, in application, protrudes through the drywall into the cavity. The slit provides for a vertically adjustable anchor.

U.S. Pat. No. 6,279,283—Hohmann et al.—Issued Aug. 28, 2601
Discloses a low-profile wall tie primarily for use in renovation construction where in order to match existing mortar height in the facing wythe a compressed wall tie is embedded in the bed joint of the brick veneer.

None of the above provide the masonry cavity wall construction system for an inner masonry wythe and an outer facing wythe with high-span anchoring wire formatives as described hereinbelow.

SUMMARY

In general terms, the invention disclosed hereby includes an anchoring system for a cavity wall. The embodiments described hereinbelow all utilize true-joint construction to reduce the height of wall reinforcement and wall anchor combinations, and thereby enable the erection of masonry block backup walls with highly uniform bed joint thicknesses and readily maintained verticality. Both the wall reinforcement and the wall anchor are wire formative elements and the elements, upon being joined, are fused together under heat and pressure. To accomplish this, the combined finished height of the assemblage of the wall reinforcement and wall anchor is limited to no greater than the diameter of wire used to form the wall anchor. By using the technique presented hereinbelow, ample mortar coverage is provided which, in turn, contributes to the accuracy of construction.

The embodiment of the invention disclosed hereby include a veneer anchoring system incorporating a swaged, double loop lock wall anchor in combination with a swaged, ladder-type wall reinforcement for use in the construction of a wall having an inner wythe with strips of insulation attached thereto. The seams between the strips of insulation are coplanar with the inner wythe bed joints. The compressively reduced in height wall anchors protrude into the cavity through the seams, which seams seal thereabout so as to maintain the integrity of the insulation and minimize air leakage along the wall anchors. In a second embodiment, wherein a truss-type wall reinforcement is used with a horizontal eye and pintle interengaging veneer anchor only the wall reinforcement is swaged. The invention contemplates that some components of the system are as described in U.S. Pat. Nos. 5,408,798; 5,454,200; and 6,279,283 and that the wire formatives hereof provide a positive interlocking connection therebetween specific for the requirements created by this true-joint application.

In the third embodiment of the invention, a box ladder-type wall reinforcement is used with a masonry block corner wythe. Here, the wall reinforcement has cross rods forming a T-head that extends into the cavity. The cross rods extend across the insulation into the cavity between the wythes. Each pair of cross rods is formed into a T-head to accommodate the threading thereinto of a wire formative veneer anchor of a bent box configuration inserted through the opening in the wall anchor. The veneer anchor is then positioned so that the insertion end is embedded in the facing wall. Wall anchors that are of limited height are described as being mounted in bed joints of the inner wythes. The close control of overall heights permits the mortar of the bed joints to flow over and about the wall reinforcement and wall anchor combination inserted in the inner wythe and insertion end of the veneer anchor in the outer wythe. The wire formatives hereof enable the anchoring system to meet the unusual requirements demanded.

OBJECTS AND FEATURES OF THE INVENTION

It is an object of the present invention to provide in a wall structure having a cavity formed by an outer wythe and an inner wythe, an anchoring system which employs true-joint wire formatives in the mortar joint of the inner wythe and is positively interconnected with a veneer tie inserted into the outer wythe.

It is another object of the present invention to provide labor-saving devices combining wall reinforcements and wall anchors to aid in the installation of inner wythe structures and providing for the securement thereto of facing veneers.

It is yet another object of the present invention to provide through utilizing true-joint techniques an anchoring system of low height and high flatness for wall reinforcement of the inner wythe.

It is a further object of the present invention to provide an anchoring system comprising a limited number of component parts that are economical of manufacture resulting in a relatively low unit cost.

It is yet another object of the present invention to provide an anchoring system which is easy to install and which meets seismic and shear resistance requirements.

It is a feature of the present invention that the flatness of the combined wall reinforcements and wall anchors facilitates obtaining uniform mortar layer thicknesses throughout the structure and improves the overall quality and trueness thereof.

It is another feature of the present invention that the veneer anchor and the combined wall tie reinforcement and wall anchor are dimensioned with a sufficiently low height so that, when inserted into the respective mortar layers, the mortar thereof can flow around the insertions end thereof to form a stronger wall structure.

It is yet another feature of the present invention that a true-joint is employed to combine the wall reinforcement and the wall anchor.

Other objects and features of the invention will become apparent upon review of the drawing and the detailed description which follows.

BRIEF DESCRIPTION OF THE DRAWING

In the following drawings, the same parts in the various views are afforded the same reference designators.

DESCRIPTION OF THE PREFERRED EMBODIMENTS

Figure 1:
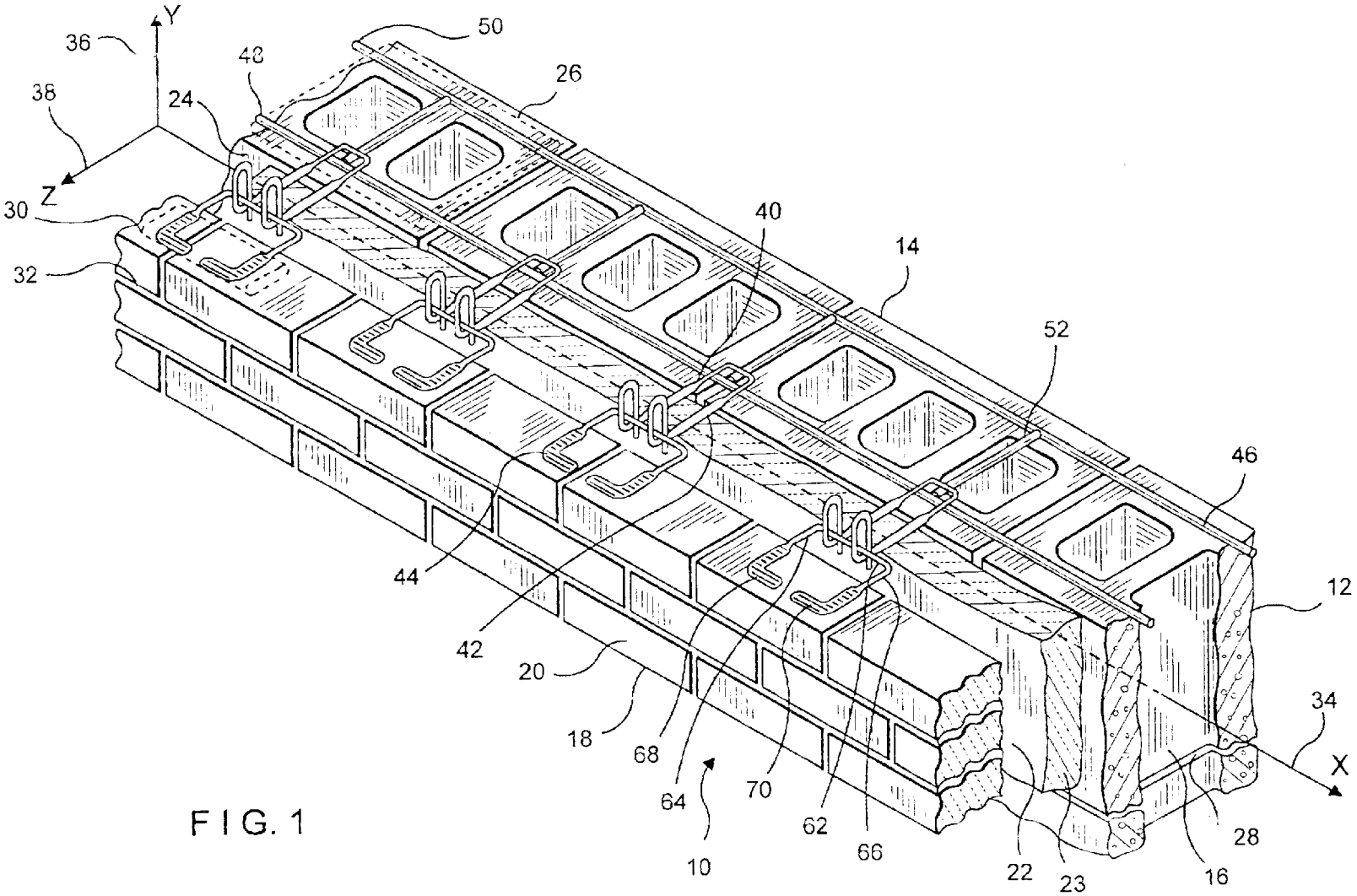
FIG. 1 is a perspective view of a first embodiment of an anchoring system for a cavity wall of this invention and shows a wall having an inner wythe of masonry block with insulation thereon and an outer wythe of brick.

Before entering into the detailed Description of the Preferred Embodiments, several terms are while specifications may vary from one building to another, the bed joints are typically 0.375-inch (approx.) in height, defined, which terms will be revisited later, when some relevant analytical issues are discussed. For the purposes of this disclosure a true joint is defined as a juncture between two wire formatives wherein the elements are fusibly and interlockingly joined under heat and pressure. To improve the interlocking aspect of the joint one or both of the elements to be joined are cold-worked by swaging indentations therein which indentations receive a wire formative therewithin. The true joint of this invention also results in a juncture which is limited in height to be no greater than the diameter of the largest of the wire formatives.

Another term defined for purposes of this application is wall reinforcement. A wall reinforcement is a continuous length of Lox All® Truss Mesh or Lox All® Ladder Mesh manufactured by Hohmann & Barnard, Inc., Hauppauge, N.Y. 11788 or equivalent adapted for embedment into the horizontal mortar joints of masonry walls. The wall reinforcements are prefabricated from cold-drawn steel wire and have parallel side rods with butt welded cross rods or truss components. The wall reinforcements for true-joint anchoring systems are generally structured from 0.148- or 0.187-inch wire that complies with ASTM Specification A 951-00. The longitudinal wires of wall reinforcements are fabricated from steel, Type 304 SS, ASTM Specification A 580/A 580M, and are deformed to have a knurled surface therearound. When corrosion protection is specified, the wall reinforcement is provided with a mill or hot-dip galvanized finish, ASTM Specification A 641/A 641M or ASTM Specification A153/A 153M, respectively.

Referring now to FIGS. 1 through 4, the first embodiment of a true-joint anchoring system for a cavity wall is now discussed in detail. For the first embodiment, a cavity wall having an insulative layer of 2 inches (approx.) and a total span of 3½inches (approx.) is chosen as exemplary. The anchoring system is referred to generally by the numeral 10. A cavity wall structure 12 is shown having an inner wythe 14 of masonry blocks 16 and an outer wythe 18 of facing brick 20. Between the inner wythe 14 and the outer wythe 18, a cavity 22 is formed.

The cavity 22 is insulated with strips of insulation 23 attached to the exterior surface 24 of the inner wythe 14 and having seams 25 between adjacent strips 23 coplanar with adjacent bed joints 26 and 28. Successive bed joints 26 and 28 are formed between courses of blocks 16. The bed joints 26 and 28 are substantially planar and horizontally disposed and, while specifications may vary from one building to another, the bed joints are typically 0.375-inch (approx.) in height. Also, successive bed joints 30 and 32 are formed between courses of bricks 20 and the joints are substantially planar and horizontally disposed. Here again, while specifications may vary from one building to another, the bed joints are typically 0.375-inch (approx.) in height. Selected bed joint 26 and bed joint 30 are constructed to be interconnected utilizing the construct hereof.

For purposes of discussion, the cavity surface 24 of the inner wythe 14 contains a horizontal line or x-axis 34 and an intersecting vertical line or y-axis 36. A horizontal line or z-axis 38 also passes through the coordinate origin formed by the intersecting x- and y-axes. A wall anchor 40 is shown which has an insulation-spanning portion 42. Wall anchor 40 is a wire formative tie which is constructed for embedment in bed joint 26 and an interconnecting with veneer anchor 44.

The masonry or wall anchor 40 is adapted from one shown and described in Hohmann, U.S. Pat. No. 5,454,200, which patent is incorporated herein by reference. The wall anchor 40 is shown in FIG. 1 as being emplaced on a course of blocks 16 in preparation for embedment in the mortar of bed joint 26. In this embodiment, the system includes a ladder-type wall reinforcement 46, a wall anchor 40 and a veneer anchor 44. The wall reinforcement 46 is constructed of a wire formative with two parallel continuous straight, side wires 48 and 50 spaced so as, upon installation, to each be centered along the outer walls of the masonry blocks 16. An intermediate wire body or a plurality of cross rods 52 are interposed therebetween and connect wire members 48 and 50 forming rung-like portions of the ladder-type reinforcement 46.

At intervals along the ladder-type reinforcement 46, spaced pairs of transverse wire members 54 are attached thereto and are attached to each other by a rear leg 56 therebetween. These pairs of wire members 54 extend into the cavity 22. The spacing therebetween limits the x-axis movement of the construct. Each transverse wire member 54 has at the end opposite the attachment end, an eye wire portion 58 formed continuous therewith. Upon installation, the eye 60 of eye wire portion 58 is constructed to be within a substantially vertical plane normal to exterior surface 24. The eye or veneer anchor receptor 60 is elongated vertically and accepts a veneer anchor threadedly therethrough. The anchor extends from eye 60, across the cavity 22, and into bed joint 30. The eye 60 is slightly wider than the wire diameter of the veneer anchor. This dimensional relationship minimizes the z-axis movement of the construct. For positive engagement, the eye 60 of eye wire portion 58 is sealed to form a closed loop.

Figure 2:
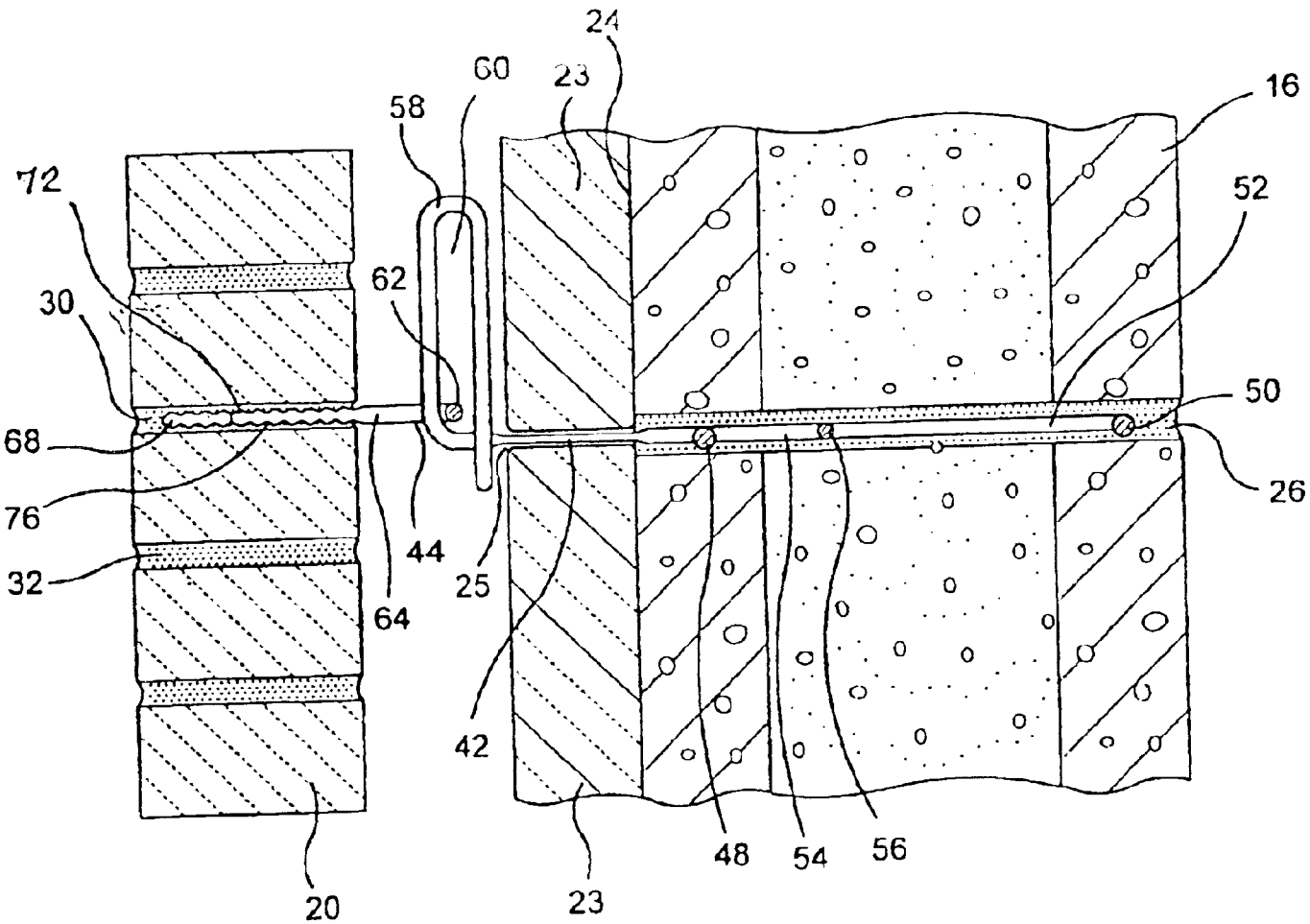
FIG. 2 is a cross-sectional view of FIG. 1 showing the relationship among wall reinforcement thereof, the extended interlocking wall anchor, and, the box-type veneer anchor.

The veneer anchor or box tie 44, FIGS. 1 and 2, is, when viewed from a top or bottom elevation, generally rectangular in shape and is a basically planar body. The veneer anchor 44 is dimensioned to be accommodated by a pair of eye wire portions 58 described, supra. The veneer anchor 44 has a rear leg portion 62, two parallel side leg portions 64 and 66, which are contiguous and attached to the rear leg portion 62 at one end thereof, and two front leg portions 68 and 70. To facilitate installation, the front leg portions 68 and 70 are spaced apart at least by the diameter of the eye wire member 58. The longitudinal axes of leg portions 68 and 70 and the longitudinal axes of the contiguous portions of the side leg portions 64 and 66 are substantially coplanar. The side leg portions 64 and 66 are structured to function cooperatively with the spacing of transverse wire members 54 to limit the x-axis movement of the construct. The veneer anchor 44 is constructed so that with insertion through eye 60, the misalignment tolerated is approximately one-half the vertical spacing between adjacent bed joints of the facing brick course. As will be described in more detail hereinbelow, the insertion portion 72 of veneer anchor 44 is considerably compressed with the vertical height being reduced. Upon compression, a pattern or corrugation 76 is impressed.

Figure 3:
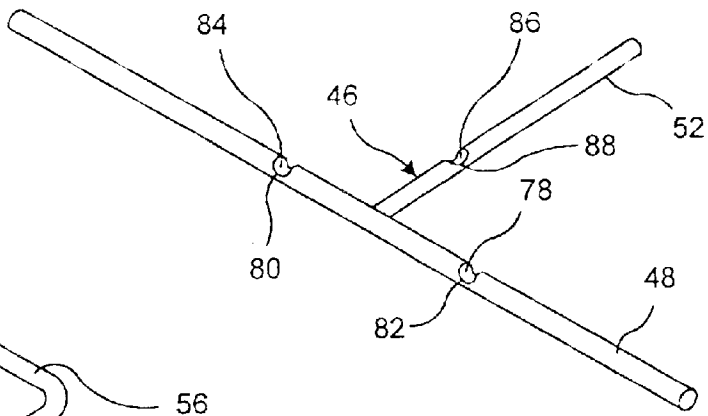
FIG. 3 is a partial perspective view from above of the wall reinforcement of FIG. 1 showing the swaged indentations thereof.
Figure 4:
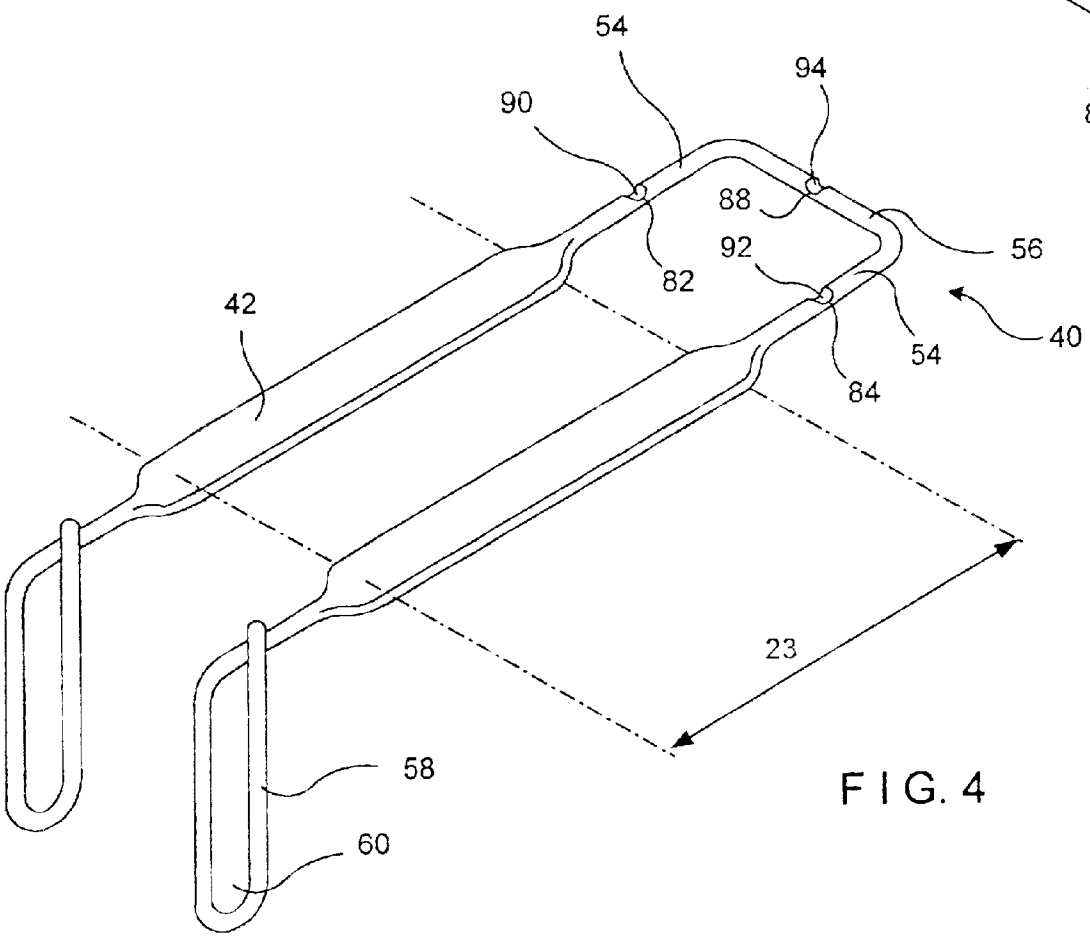
FIG. 4 is a partial perspective view from below of the, wall anchor of FIG. 1 showing the swaged indentations thereof corresponding to those of the wall reinforcement.

Referring now to FIGS. 3 and 4 details of the wall reinforcement and wall anchor of the above-described arrangement of wire formatives are shown. For the true joint, swaged into side wire 48 of wall reinforcement 46 are indentations 78 and 80 at attachment sites 82 and 84, respectively; and into cross rod 52, indentation 86 at attachment site 88. In this embodiment, there are corresponding swaged indentations 90 and 92 in the pair of transverse wire members 54 at attachment sites 82 and 84, respectively; and indentation 94 at attachment site 88.

During assembly, the two components—the wall anchor 40 and the wall reinforcement 46—are fusibly joined at attachment sites 82, 84 and 88 under heat and pressure. Upon assembly, the true joints at the attachment sites 82, 84 and 88 have a height no greater than the diameter of the wire of wall anchor 40. Thus, for example, if the 0.187-inch diameter wire is employed for all components, upon insertion of the assemblage into bed joint 26 an equal height of mortar (as best seen in FIG. 2) would surround the wall reinforcement 46 and the insertion end of the wall anchor 40. Similarly because of the flatness of the combined wall reinforcement and wall anchor assemblage, the ability to maintain verticality of the inner wythe is enhanced.

During the cold working of system components in addition to the swaged indentations, the insertion end of anchor 44 and the insulation-spanning portion 42 of wall anchor 40 are compressively reduced in height. As described in a prior patent of the present inventors, namely, Hohmann et al., U.S. Pat. No. 6,279,283, the insertion ends of the veneer anchor is, upon cold-forming, optionally impressed with a pattern on the mortar-contacting surfaces. For this application, while several patterns—corrugated, diamond and cellular—are discussed in the patent, only the corrugated pattern is employed. The ridges and valleys of the corrugations are shown in FIGS. 1 and 2 and are impressed so that, upon installation, the corrugations are parallel to the x-axis.

The cavity, as previously mentioned, has an insulation layer 23 which is shown in FIGS. 1 and 2. The successive insulation strips 23 when in an abutting relationship the one with the other are sufficiently resilient to seal at seam 25 without air leakage therebetween. As the extended insulation-spanning portions 42 of wall anchor 40 are flattened, there is minimal interference with seal at seam 25.

Figure 5:
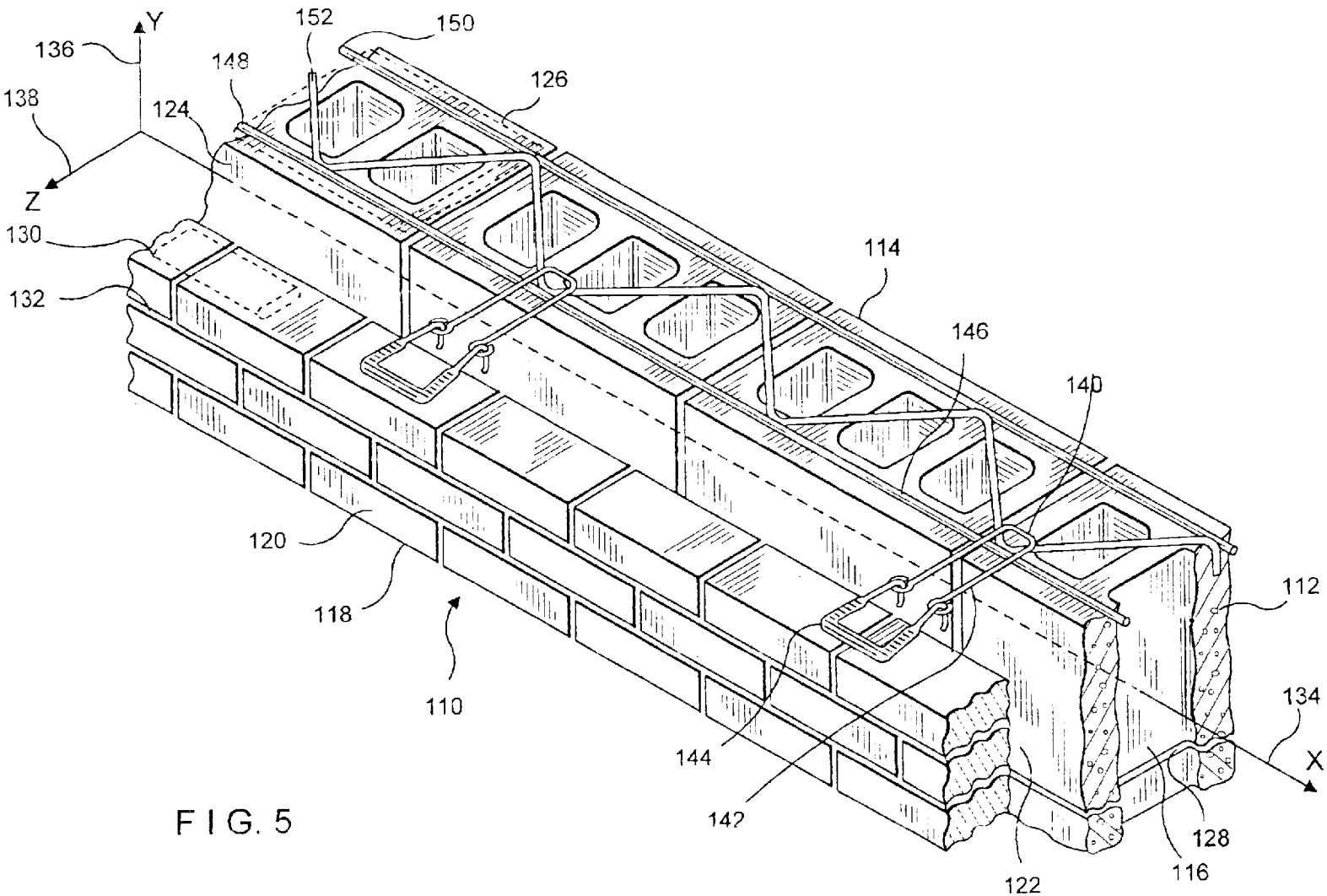
FIG. 5 is a perspective view of a second embodiment of a anchoring system for a cavity wall, similar to FIG. 1, but employing a truss mesh reinforcement in the inner wythe, a horizontal eye wall anchor, and a rectangular pintle veneer anchor.
Figure 6:
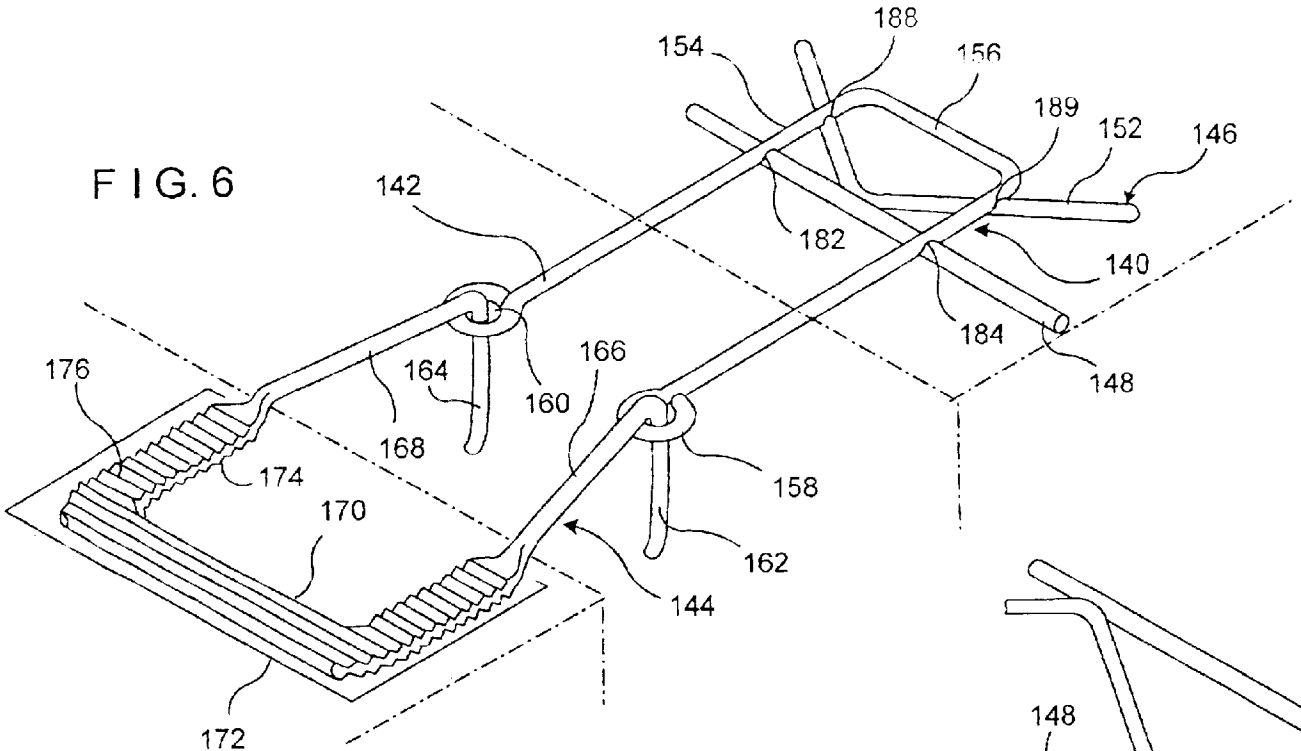
FIG. 6 is a partial perspective view of FIG. 5 showing a portion of the wall reinforcement, the wall anchor and the veneer anchor.
Figure 7:
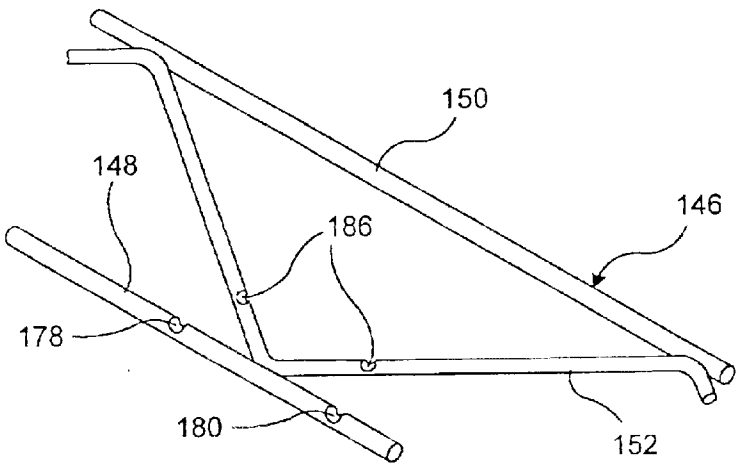
FIG. 7 is a partial perspective view of FIG. 6 showing the wall reinforcement of FIG. 5 and the swaged indentations thereof corresponding to the attachment sites of the wall anchor.

The description which follows is of a second embodiment of the true-joint anchoring systems of this invention. For ease of comprehension, where similar parts are used reference designators "100" units higher are employed. Thus, the veneer anchor 144 of the second embodiment is analogous to the veneer anchor 44 of the first embodiment. Referring now to FIGS. 5 through 7, the second embodiment of an anchoring system of this invention is shown and is referred to generally by the numeral 110. As in the first embodiment, a wall structure 112 is shown having an inner wythe 114 of masonry blocks 116 and an outer wythe 118 of facing brick 120. Between the inner wythe 114 and the outer wythe 118, a cavity 122, is formed having an exterior surface 124. Successive bed joints 126 and 128 are formed between courses of blocks 116 and the joints are substantially planar and horizontally disposed. Also, successive bed joints 130 and 132 are formed between courses of bricks 120 and the joints are substantially planar and horizontally disposed. Selected bed joint 126 and bed joint 130 are constructed to be interconnected utilizing the construct hereof. While specifications may vary from one building to another, the bed joints hereof are typically 0.375 inch (approx.) in height.

For purposes of discussion, the exterior surface 124 of the interior wythe 114 contains a horizontal line or x-axis 134 and an intersecting vertical line or y-axis 136. A horizontal line or z-axis 138 normal to the xy-plane also passes through the coordinate origin formed by the intersecting x- and y-axes.

The wall anchor 140 is shown in FIG. 6 as having side wires 142 for interconnection with veneer anchor 144 and further is shown as being emplaced on a course of blocks 116 in preparation for embedment in the mortar of bed joint 126. In this embodiment, a truss-type wall reinforcement 146 is constructed of a wire formative with two parallel continuous straight side wire members 148 and 150 spaced so as, upon installation, to each be centered along the outer walls of the masonry blocks 116. An intermediate wire body 152 is interposed therebetween and connect wire members 148 and 150 separating and connecting side wires 148 and 150 of wall reinforcement 146.

Referring now to FIGS. 5, 6 and 7, at intervals along the truss-type reinforcement 146, spaced pairs of transverse wire members 154 are attached thereto and are attached to each other by a rear leg 156 therebetween. These pairs of wire members 154 extend into the cavity 122. Each transverse wire member 154 has at the end opposite the attachment end an eye wire portion 158 formed continuous therewith. Upon installation, the eyes 160 of eye wire portion 158 are constructed to be within a substantially horizontal xz-plane normal to exterior surface 124. The eyes 160 are horizontally aligned to accept the pintles of a veneer anchor 144 threaded therethrough. The eyes 160 are slightly larger than the diameter of the pintles, which dimensional relationship restricts the movement of the construct in the xz-plane. For ensuring engagement, the pintles of veneer anchor 144 are available in a variety of lengths to accommodate the misalignment, if any, of for example bed joint 126 with bed joint 130.

The veneer anchor 144 is, when viewed from a top or bottom elevation, generally U-shaped. The veneer anchor 144 is dimensioned to be accommodated by a pair of eye wire portions 158 described, supra. The veneer anchor 144 has two rear leg portions or pintles 162 and 164, two substantially parallel side leg portions 166 and 168, which are substantially at right angles and attached to the rear leg portions 162 and 164, respectively, and a front leg portion 170. An insertion portion 172 of veneer tie 144, which is considerably compressed upon installation extends beyond the cavity 122 into bed joint 130. Insertion portion 172 includes front leg portion 170 and part of side leg portions 166 and 168 upon compression, a pattern or corrugation 176 is impressed. The longitudinal axes of side leg portions 166 and 168 and the longitudinal axis of the front leg portion 170 are substantially coplanar.

The insertion portion 172 of veneer tie 144 is considerably compressed and, while maintaining the same mass of material per linear unit as the adjacent wire formative, the vertical height 174 is reduced. The vertical height 174 of insertion portion 172 is reduced so that, upon installation, mortar of bed joint 130 flows around the insertion portion 172. Upon compression, a pattern or corrugation 176 is impressed on either or both of the upper and lower surfaces of insertion portion 172. When the mortar of bed joint 130 flows around the insertion portion, the mortar flows into the valleys of the corrugations 176. The corrugations enhance the mounting strength of the veneer tie 144 and resist force vectors along the z-axis 138. With wall tie 144 compressed as described, the wall tie is characterized by maintaining substantially all the tensile strength as prior to compression.

In the second embodiment, and referring now to FIGS. 6 and 7, the details of the wall reinforcement 146 and wall anchor 140 of the above-described arrangement of wire formatives are shown. For the true joint, swaged into side wire 148 of wall reinforcement 146 are indentations 178 and 180 at attachment sites 182 and 184, respectively; and into intermediate wire body indentations 186 at attachment sites 188 and 189.

During assembly, the two components—the wall anchor 140 and the wall reinforcement 146—are fusibly joined at attachment sites 182, 184 and 188 and 189 under heat and pressure. Upon assembly, the true joints at the attachment sites 182, 184,188 and 189 have a height no greater than the diameter of the wire of wall anchor 140. Thus, for example, if the 0.187-inch diameter wire is employed for all components, upon insertion of the assemblage into bed joint 126 an equal height of mortar would surround the wall reinforcement 146 and the insertion end of the wall anchor 140. As in the first embodiment, because of the flatness of the combined wall reinforcement and wall anchor assemblage, the ability to maintain verticality of the inner wythe is enhanced.

During the cold working of system components in addition to the swaged indentations, the insertion end of anchor 144 is compressively reduced in height. As described in a prior patent of the present inventors, namely, Hohmann et al., U.S. Pat. No. 6,279,283, the insertion ends of the veneer anchor is, upon cold-forming, optionally impressed with a pattern on the mortar-contacting surfaces. For this application, while several patterns—corrugated, diamond and cellular—are discussed in the patent, only the corrugated pattern is employed. The ridges and valleys of the corrugations are shown in FIGS. 5 and 6 and are impressed so that, upon installation, the corrugations are parallel to the x-axis 134.

The description which follows is of a third embodiment of the high-span anchoring system of this invention. For ease of comprehension, where similar parts are used reference designators "200"units higher are employed. Thus, the wall anchor 240 of the third embodiment is analogous to the wall anchor 40 of the first embodiment. The veneer anchor of this embodiment is adapted from that shown in U.S. Pat. No. 5,454,200 to R. P. Hohmann; and the T-head, from that shown in U.S. Pat. No. 5,816,008 to R. P. Hohmann.

Figure 8:
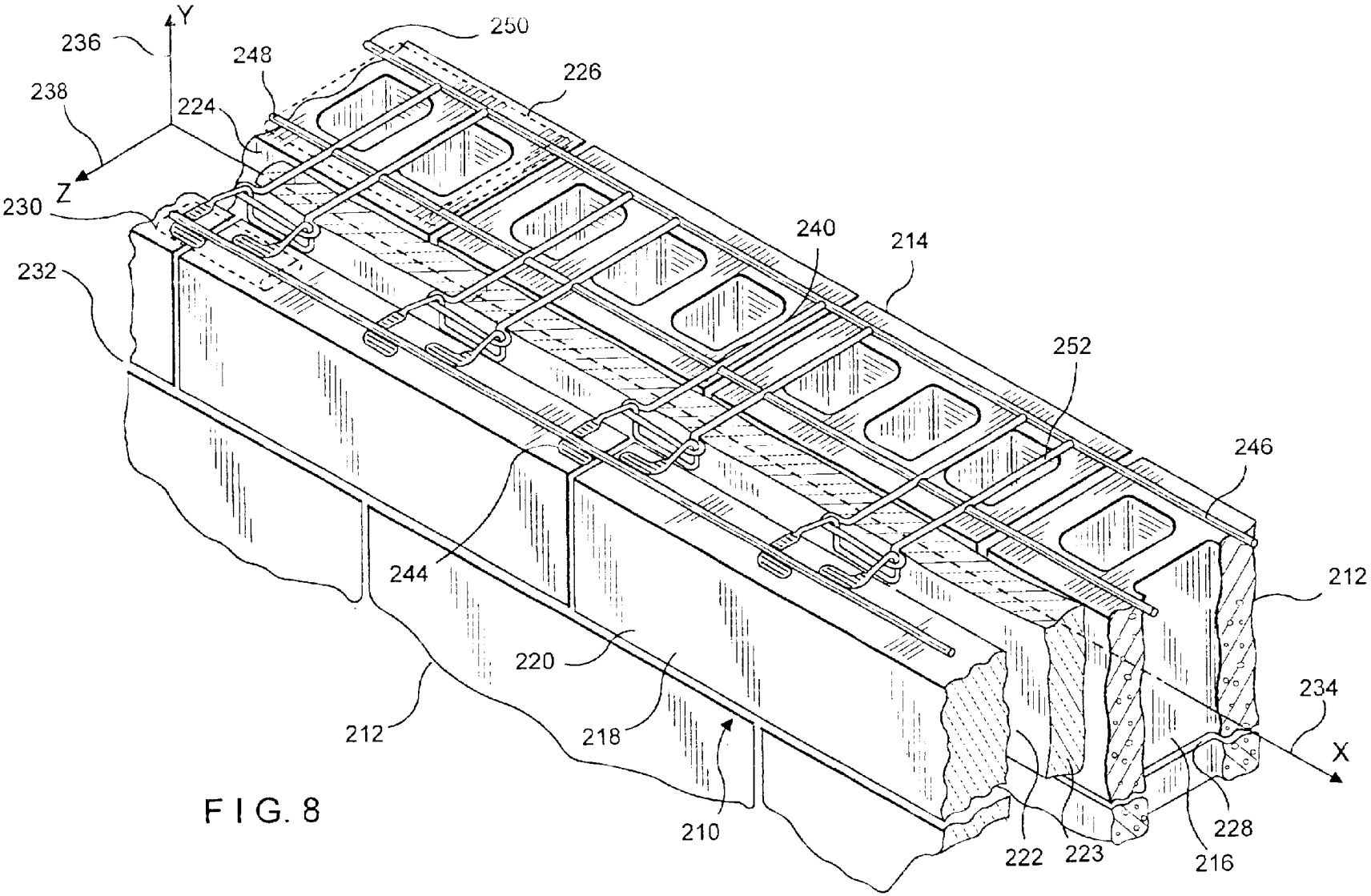
FIG. 8 is a partial perspective view of a third embodiment of an anchoring system for a cavity wall similar to FIG. 1, but employing a T-head, ladder-box mesh combined wall reinforcement and wall anchor in the inner wythe and a bent-box anchor in the outer wythe; and, FIG. 9 a partial perspective view of FIG. 8 showing a portion of the wall reinforcement, the wall anchor and the veneer anchor in relation to the cavity and the insulation therein.
Figure 9:
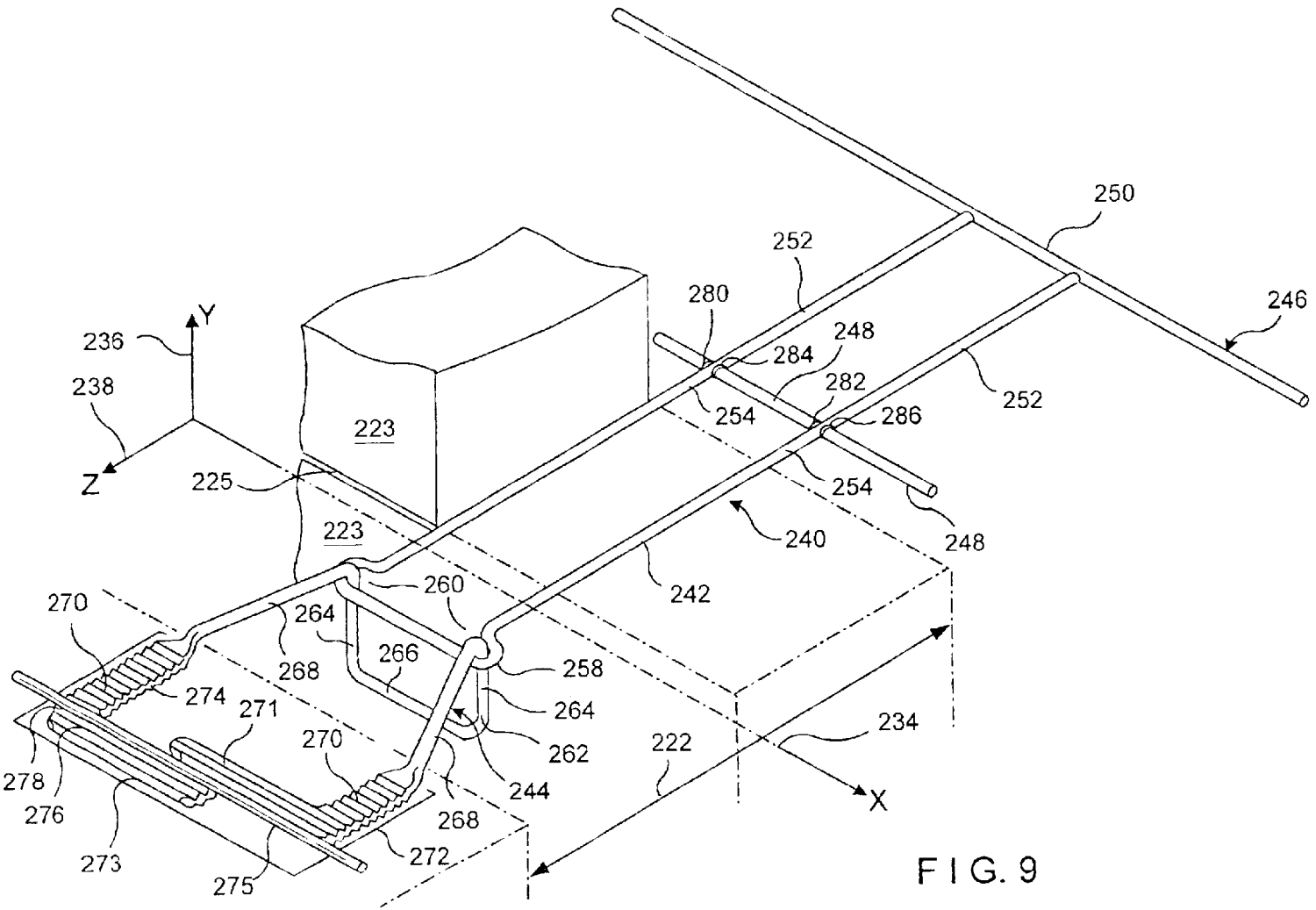

Referring now to FIGS. 8 and 9, the third embodiment of a true-joint anchoring system of this invention is shown and is referred to generally by the numeral 210. In this embodiment, a wall structure 212 is shown having an inner wythe 214 of masonry blocks 216 and an outer wythe 218 of facing stone 220. Between the inner wythe 214 and the outer wythe 218, a cavity 222 is formed, which cavity 222 has an exterior surface 224. In the third embodiment, successive bed joints 226 and 228 are formed between courses of blocks 216 and the joints are substantially planar and horizontally disposed. Also, successive bed joints 230 and 232 are formed between courses of facing stone 220 and the joints are substantially planar and horizontally disposed. For each structure, the bed joints 226, 228, 230 and 232 are specified as to the height or thickness of the mortar layer and such thickness specification is rigorously adhered to so as to provide the uniformity inherent in quality construction. Selected bed joint 226 and bed joint 230 are constructed to align, that is to be substantially coplanar, the one with the other.

For purposes of discussion, the exterior surface 224 of the inner wythe 214 contains a horizontal line or x-axis 234 and an intersecting vertical line or y-axis 236. A horizontal line or z-axis 238 normal to the xy-plane also passes through the coordinate origin formed by the intersecting x- and y-axes. In the discussion which follows, it will be seen that the various anchor structures are constructed to restrict movement interfacially—wythe vs. wythe—along the z-axis and, in this embodiment, along the x-axis. The system 210 includes a masonry wall anchor 240 constructed for embedment in bed joint 226, which, in turn, includes a cavity-spanning or extension portion 242. Further, the system 210 includes a wire formative anchor member 244 for embedment in bed joint 230.

The components of the anchoring system 210 are shown in FIG. 8 as being emplaced on a course of blocks 216 and facing stone 220 in preparation for embedment in the mortar of bed joints 226 and 230, respectively. In the best mode of practicing the invention, a combined box ladder-type wall reinforcement and wall anchor assembly 246 is constructed of a wire formative with two parallel continuous straight wire members 248 and 250 spaced so as, upon installation, to each be centered along the outer walls of the masonry blocks 216. The structure further includes intermediate wire bodies or cross rod portions 252 of wall anchor 240 interposed therebetween and connecting wire members 248 and 250. These cross rod portions 252 form rung-like elements of the reinforcement structure 246. The cross rod portions 252 at intervals along the wall reinforcement 246 extend across wire members 248 and provide spaced pairs of transverse wire member portions 254. The other end of cross rod portions 252 are electric resistance welded to wire reinforcement 250. The pairs of wire members 254 are contiguous with extension portions 242 and extend across the cavity 222 to veneer anchor 244. As will become clear by the description which follows, the spacing between the transverse wire member 254 is constructed to limit the x-axis movement of the construct. Each pair of transverse wire members 254 has at the end opposite the attachment end a T-head portion 258 formed contiguous therewith.

Upon installation, the receptors 260 of T-head portion 258 is constructed to be within a substantially horizontal xz-plane normal to exterior surface 224. The receptor 260 is dimensioned to accept the tongue or bent portion of veneer anchor 244 and is slightly larger than the width of the tongue portion. This relationship minimizes the movement of the construct in an xz-plane.

The veneer anchor 244 is generally a bent box configuration and is dimensioned to be accommodated by the T-head receptor 260 of wall anchor 240 previously described. The veneer, anchor 244 has a tongue portion 262 with two parallel side leg portions 264 and connecting leg 266, and two cavity-spanning leg portions 268 contiguous therewith. The leg portions continue to an insertion portion and the insertion portion side legs 270 have been compressively reduced in height. The insertion portion is completed with front leg portions 271 and 273 which are spaced apart at least by the diameter of the veneer reinforcing wire member 275. An insertion portion 272 of veneer anchor 244, upon installation, extends beyond cavity 222 into bed joint 230, which insertion portion includes front leg portions 271 and 273 and side leg portions 270 adjacent to front leg portions 271 and 273, respectively. The longitudinal axes of leg portions 268, 270, 271, and 273 are substantially coplanar. The side leg portions 264 and connecting leg 266 are structured to function cooperatively with the spacing of the T-head 258 adjoining transverse wire members 254 to limit movement of the construct in the xz-plane.

The insertion portion 272 is considerably compressed and, while maintaining the same mass of material per linear unit as the adjacent wire formative, the vertical height 274 is reduced. The vertical height 274 of insertion portion 272 is reduced so that, upon installation, mortar of bed joint 230 flows around the insertion portion 272. Upon compression, a pattern or corrugation 276 is impressed on insertion portion 272 and, upon the mortar of bed joint 230 flowing around the insertion portion, the mortar flows into the corrugations 276. For enhanced holding, the corrugations 276 are, upon installation, substantially parallel to x-axis 234. In this embodiment, an indentation 278 is swaged into leg portion 270 opposite the opening between front leg portions 271 and 273, which indentation is dimensioned to accommodate veneer reinforcing wire 275. With the insertion end 272 of veneer anchor 244 as described, the wall anchor is characterized by maintaining substantially all the tensile strength as prior to compression while acquiring a desired low profile.

Referring now to FIG. 9 details of the combined wall reinforcement and wall anchor assembly 246 of the above-described arrangement of wire formatives are shown. For the true joint, swaged into the cross rod portions 252 of wall anchor 240 are indentations 280 and 282 at attachment sites 284 and 286, respectively. During assembly, the two components—the wall anchor 240 and the wall reinforcement 246—are fusibly joined at attachment sites 284 and 286 under heat and pressure. Upon assembly, the true joints at the attachment sites 284 and 286 have a height no greater than the diameter of the wire of wall anchor 240. Thus, for example, if the 0.187-inch diameter wire is employed for all components, upon insertion of the assemblage into bed joint 226 an equal height of mortar would surround the wall reinforcement 246 and the insertion end of the wall anchor 240. Similarly because of the flatness of the combined wall reinforcement and wall anchorf assemblage, the ability to maintain verticality of the inner wythe is enhanced.

During the cold working of system components in addition to the swaged indentations, the insertion end of anchor 244 is compressively reduced in height. As described in a prior patent of the present inventors, namely, Hohmann et al., U.S. Pat. No. 6,279,283, the insertion ends of the veneer anchor is, upon cold-forming, optionally impressed with a pattern on the mortar-contacting surfaces. For this application, while several patterns—corrugated, diamond and cellular—are discussed in the patent, only the corrugated pattern is employed. The ridges and valleys of the corrugations are shown in FIGS. 8 and 9 and are impressed so that, upon installation, the corrugations are parallel to the x-axis.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. An anchoring system for use in a wall having an inner wythe and an outer wythe in a spaced apart relationship forming a cavity therebetween, said inner wythe formed from a plurality of successive courses of masonry blocks with a bed joint of predetermined height between each two adjacent courses, said bed joint upon construction being filled with mortar, said anchoring system comprising:

a wall reinforcement adapted for insertion in said bed joint and adapted for mounting wall anchors at attachment sites at intervals therealong, said wall reinforcement being a wire formative;

a plurality of wall anchors for attachment at one end thereof at spaced intervals along said wall reinforcement, each of said wall anchors being a wire formative of wire having a predetermined diameter, each of said wall anchors having at least two attachment sites;

at least two indentations swaged into one or more of said wire formatives at the respective ones of said attachment sites thereof; and, a juncture fusibly and interlockingly connecting said wall anchors to said wall reinforcement the one to the other at corresponding said indentations with the combined finished height of the fusibly connected wall reinforcement and wall anchor being not greater than said predetermined diameter of said wire formative of said wall anchor.

2. An anchoring system as described in claim 1 wherein said wall anchor further comprises:

an eye wire portion at the end opposite said attachment end, said eye wire portion, upon installation of said combined wall reinforcement and wall anchor, adapted for disposition in said cavity.

3. An anchoring system as described in claim 2 wherein said outer wythe is formed from a plurality of successive courses of bricks with a bed joint of predetermined height between each two adjacent courses, said anchoring system further comprising:

a veneer anchor for interengagement with said eye wire portion of said wall anchor, said veneer anchor, upon installation, adapted for insertion in said bed joint of said outer wythe.

4. An anchoring system as described in claim 3 wherein said eye wire portion has two horizontally disposed eyes and said veneer anchor has two pintle legs interengaging therewith in close fitting relationship and thereby limiting movement in a horizontal plane.

5. An anchoring system as described in claim 3, wherein said cavity is insulated with strips of insulation attached therein to said inner wythe, said strips having seams therebetween, and wherein said wall anchor further comprises an insulation spanning portion connecting said eye wire portion and said attachment end of said wall anchor, said insulation-spanning portion adapted for installation in said seams between said strips of said insulation.

6. An anchoring system as described in claim 5 wherein said insulation-spanning portion of said wall anchor is compressed and adapted for disposition in said seams between said strips and for sealing of said strips thereabout, thereby reducing air leakage about said insulation-spanning portion.

7. A wall anchor/wall reinforcement device for use in a wall masonry backup of a cavity wall structure, said backup wall formed from a plurality of successive courses of masonry blocks with a bed joint of predetermined height between each two adjacent courses, said bed joint upon construction being filled with mortar, said device comprising:

a wall reinforcement adapted for insertion in said bed joint wand adapted for mounting wall anchors at attachment sites at intervals therealong, said wall reinforcement being a wire formative having two parallel side wires and an intermediate connecting wire or wires, said wall reinforcement limited in height to the diameter of said parallel side wires;

a plurality of wall anchors adapted for attachment at one end thereof at spaced intervals along said wall reinforcement, each of said wall anchors being a wire formative of wire having a predetermined diameter, each of said wall anchors having at least two attachment sites corresponding to intersecting wire formatives;

at least two indentations swaged into one or more of said wire formatives at the respective ones of said attachment sites thereof; and, a juncture fusibly and interlockingly connecting said wall anchors to said wall reinforcement the one to the other at corresponding said indentations with the combined finished height of the fusibly connected wall reinforcement and wall anchor being not greater than said predetermined diameter of said wire formative of said wall anchor.

8. A device as described in claim 7 wherein at each attachment site a swaged indentation is formed in the wire formative of said wall reinforcement, said intersecting wire formatives fused by heat and pressure and thereby forming a unitary device of said wall reinforcement and said wall anchor with a height at the attachment site being no greater than the diameter of said wire formative of said wall anchor.

9. A device as described in claim 7 wherein said intermediate wire of said wall reinforcement is integral with said wall anchor.

10. A device as described in claim 7 wherein at each attachment site a swaged indentation is formed in each intersecting ones of said wire formatives, said intersecting wire formatives fused by heat and pressure and thereby forming a unitary device of said wall reinforcement and said wall anchor with a height at the attachment site being no greater than the diameter of said wire formative of said wall anchor.

11. A device as described in claim 7 wherein at each attachment site a swaged indentation is formed in the wire formative of said wall anchor, said intersecting wire formatives fused by heat and pressure and thereby forming a unitary device of said wall reinforcement and said wall anchor with a height at the attachment site being no greater than the diameter of said wire formative of said wall anchor.

12. A true-joint anchoring system for use in a wall having an inner wythe and an outer wythe in a spaced apart relationship forming a cavity therebetween, said inner wythe formed from a plurality of successive courses of masonry blocks with a bed joint of a 0.375-inch maximum height between each two adjacent courses, said bed joint upon construction being filled with mortar, said device comprising:

a wall reinforcement adapted for insertion in said bed joint and adapted for mounting wall anchors at attachment sites at intervals therealong, said wall reinforcement being a wire formative;

a plurality of wall anchors adapted for attachment at one end thereof at spaced intervals along said wall reinforcement, each of said wall anchors being a wire formative of wire having a 0.187-inch maximum diameter, each of said wall anchors having at least two attachment sites;

at least two indentations swaged into one or more of said wire formatives at the respective ones of said attachment sites thereof; and, a true-joint formed by fusibly and interlockingly connecting said wall anchors to said wall reinforcement the one to the other at corresponding said indentations, said true-joint being formed under heat and pressure to reach a combined finished height of the wall reinforcement and wall anchor device of less than said 0.187-inch diameter of said wire formative of said wall anchor.

13. A true-joint anchoring system as described in claim 12 wherein the ratio of wall anchor diameter to bed joint height is 1:2.

14. A true-joint anchoring system as described in claim 13 wherein said outer wythe is formed from a plurality of successive courses of bricks with a bed joint of predetermined height between each two adjacent courses, said true-joint anchoring system further comprises:

a veneer anchor receptor at the end opposite said attachment end, said veneer anchor receptor, upon installation of said combined wall reinforcement and wall anchor, adapted for disposition in said cavity; and a veneer anchor for interengagement with said eye wire portion of said wall anchor, said veneer anchor, upon installation, adapted for insertion in said bed joint of said outer wythe.

15. A true-joint anchoring system as described in claim 14 wherein said cavity is insulated with strips of insulation attached therein to said inner wythe, said strips having seams therebetween, and wherein said wall anchor further comprises:

an insulation-spanning portion connecting said veneer anchor receptor and said attachment end of said wall anchor, said insulation-spanning portion adapted for installation in said seams between said strips of said insulation, said insulation-spanning portion of said wall anchor is compressed adapted for disposition in said seams and for sealing of said strips thereabout, thereby reducing air leakage about said insulation-spanning portions.

* * * * *